US006035857A

United States Patent [19]

Hartelius et al.

[11] Patent Number: 6,035,857

[45] Date of Patent: Mar. 14, 2000

[54] FINGERNAIL ENHANCING CRAFT SET

[75] Inventors: Mark E. Hartelius, Tinley Park; Richard W. Carton; Jeff A. Alward, both of Chicago, all of Ill.

[73] Assignee: Strombecker Corporation, Chicago, Ill.

[21] Appl. No.: 09/244,244

[22] Filed: Feb. 3, 1999

[51] Int. Cl.[7] ..... A45D 29/00

[52] U.S. Cl. ..... 132/73; 211/39; 211/128.1

[58] Field of Search ..... 132/73, 73.5, 73.6, 132/75, 75.6, 286, 314; 206/740, 743, 558, 564, 1.8; D28/61; 211/39, 11, 128.1

[56] References Cited

U.S. PATENT DOCUMENTS

| | | | |
|---|---|---|---|
| 1,844,698 | 2/1932 | Snyder | 211/39 |
| 1,928,035 | 9/1933 | Snyder | 132/73.5 |
| 2,477,921 | 8/1949 | Batton et al. | 132/314 |
| 2,563,315 | 8/1951 | Uyl | 132/73.5 |
| 3,613,696 | 10/1971 | Paule et al. | 132/75 |
| 3,774,993 | 11/1973 | Senee | 132/73.5 |
| 4,296,766 | 10/1981 | Benis | 132/73 |
| 4,303,086 | 12/1981 | Wang | 132/73.5 |
| 5,139,036 | 8/1992 | Pickard | 132/75 |
| 5,640,979 | 6/1997 | Trenary | 132/73 |

*Primary Examiner*—Todd E. Manahan
*Attorney, Agent, or Firm*—Jones, Day, Reavis & Pogue

[57] ABSTRACT

A fingernail enhancement craft set having a base with accessories and tools for decorating fingernails. The base has five regions of progressively higher surfaces where each of the surfaces include openings, recesses or bins for storing items to decorate the nails. Such items include nail polish, glitter and stickers, as well as items useful when working on the nails such as cotton balls, cotton swabs, emery boards and tools. In particular, the tools are a magnifying lense and a fan. The first region at the lowest vertical level includes indentations for the placement of the fingers of the nails to be decorated. The remaining regions store or locate and support the accessories and tools.

6 Claims, 6 Drawing Sheets

FINGERNAIL ENHANCING CRAFT SET

BACKGROUND OF THE INVENTION

1. Field of the Invention

The present invention relates to a craft set and more particularly to a craft set to facilitate the decorating of an individual's fingernails.

2. Description of the Related Art

There are and have been numerous craft and/or toy sets in the marketplace, especially craft sets for children. Included are sets which allow children to mimic adult activity or to enhance creativity in the form of art projects.

There is a continuing need in the marketplace for new and creative products for entertainment purposes, play value and to enhance creative and artistic skills.

BRIEF SUMMARY OF THE INVENTION

What is offered here is a new and exciting craft set primarily for children with enhanced play and entertainment value and for encouraging artistic and other creative talents. What is described is a craft set comprising a base having a plurality of regions at different vertical levels and wherein the regions include recesses or openings; and at least one elongated, flexible element connected to the base at an opening and having an extended end, the extended and for supporting a useful item relating to a craft.

An object of the present invention is to provide a craft set to facilitate the decorating of fingernails, especially the nails of children. Another aspect of the present invention is to provide a craft set having a multi-purpose base for storing craft items, for supporting movable equipment and for providing a work space. A further aim of the present invention is to provide a craft set which is relatively inexpensive and simple to use. Yet another advantage of the present invention is to provide a craft set which is aesthetically pleasing, fun to use and which enhances a child's creativity and artistic abilities. Still another advantage of the present invention is to provide a nail decorating craft set having a base for the storage of nail polish containers, a buffer, nail decorating items and nail enhancing equipment. Yet another aspect of the invention is to provide a child's nail enhancing set including a base with a work portion, storage portions and a connection to enhancing equipment, such as a buffer, a magnifying lense and a fan.

A more complete understanding of the present invention and other objects, aspects, aims and advantages thereof, will be gained from a consideration of the following description of the preferred embodiment read in conjunction with the accompanying drawings provided herein.

DESCRIPTION OF THE PREFERRED EMBODIMENT

Figure 1:
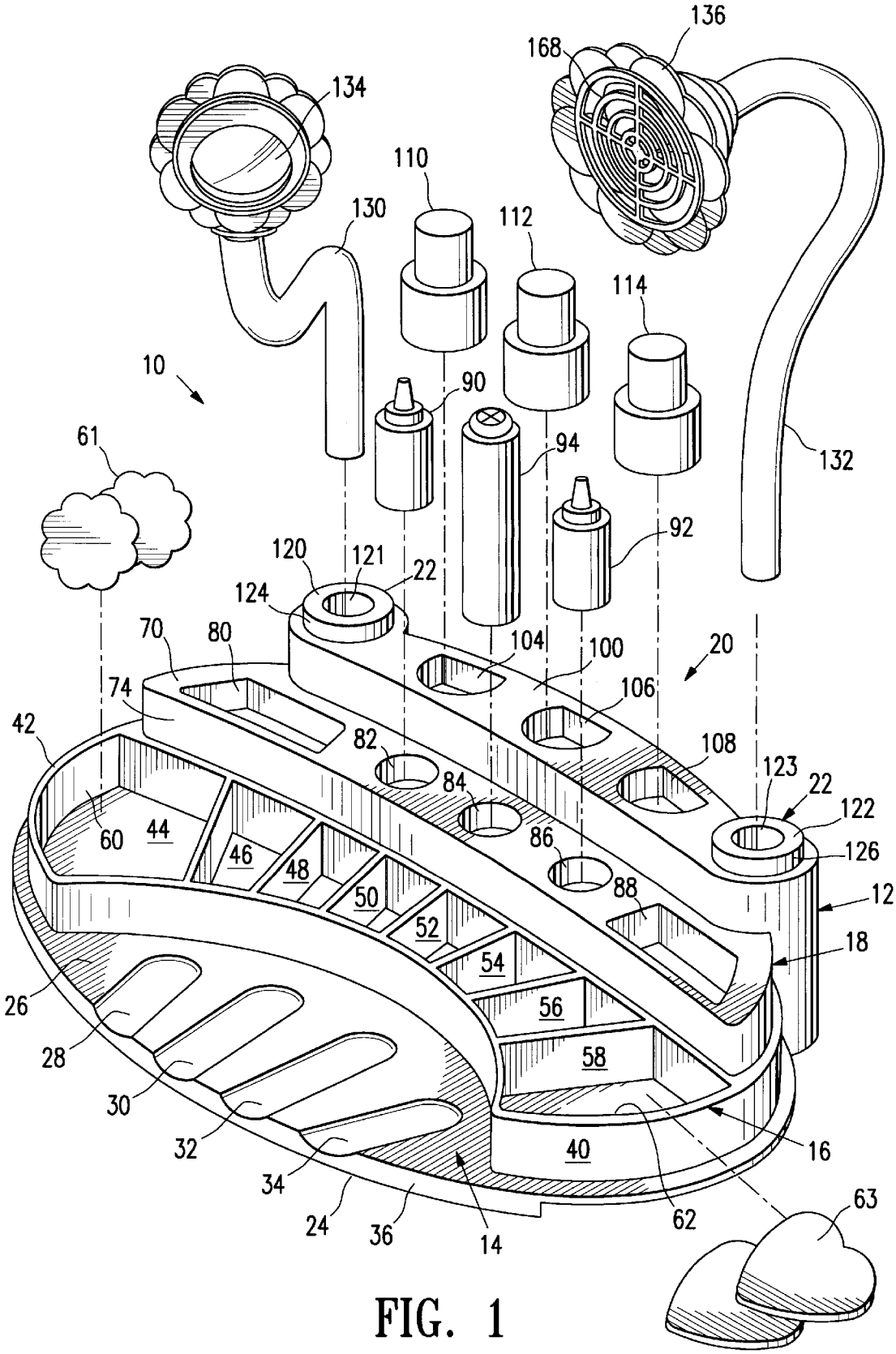
FIG. 1 is an exploded perspective view of a fingernail enhancing craft set.
Figure 2:
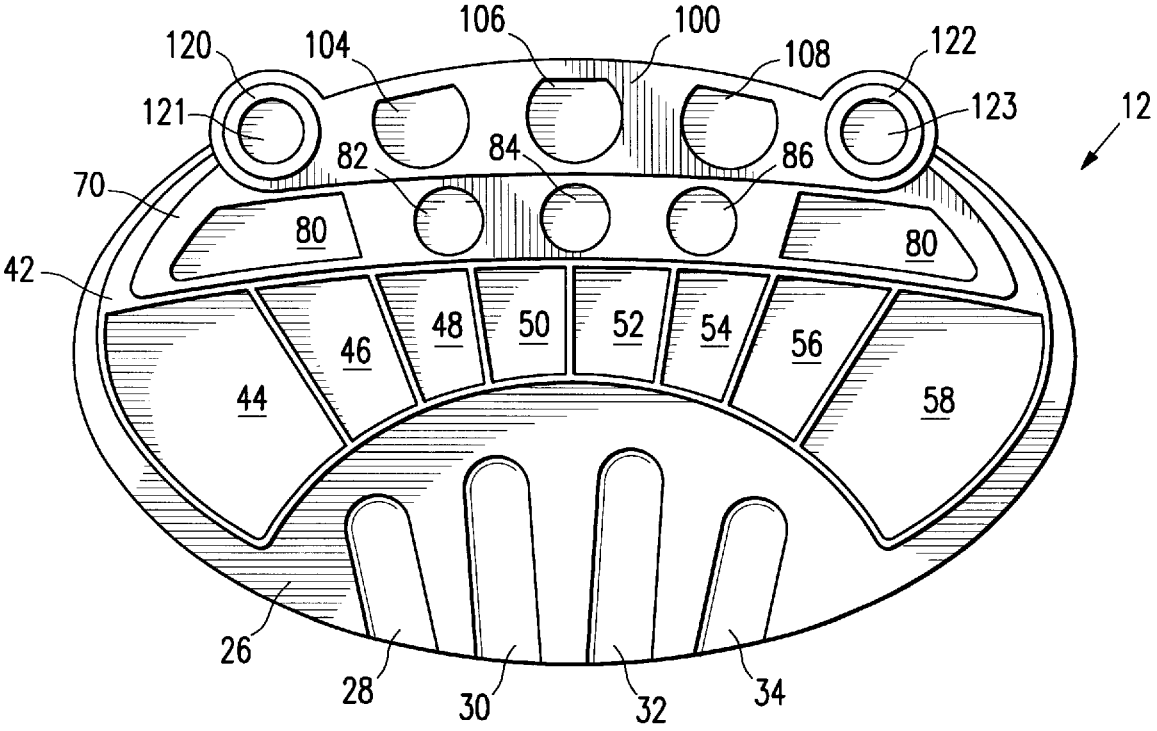
FIG. 2 is a top plan view of the base for the fingernail enhancing craft set.
Figure 3:
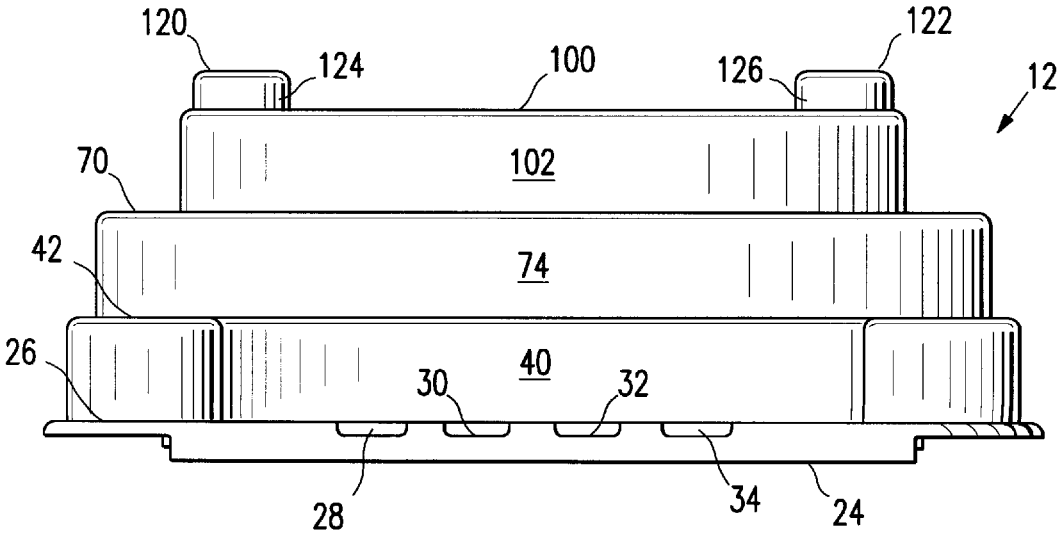
FIG. 3 is a front elevation view of the base shown in FIG. 2.
Figure 4:
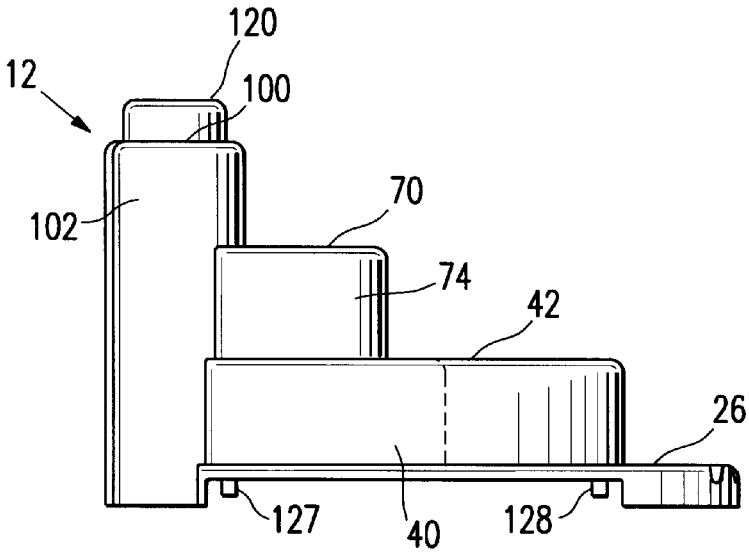
FIG. 4 is a side elevation view of the base shown in FIGS. 2 and 3.
Figure 5:
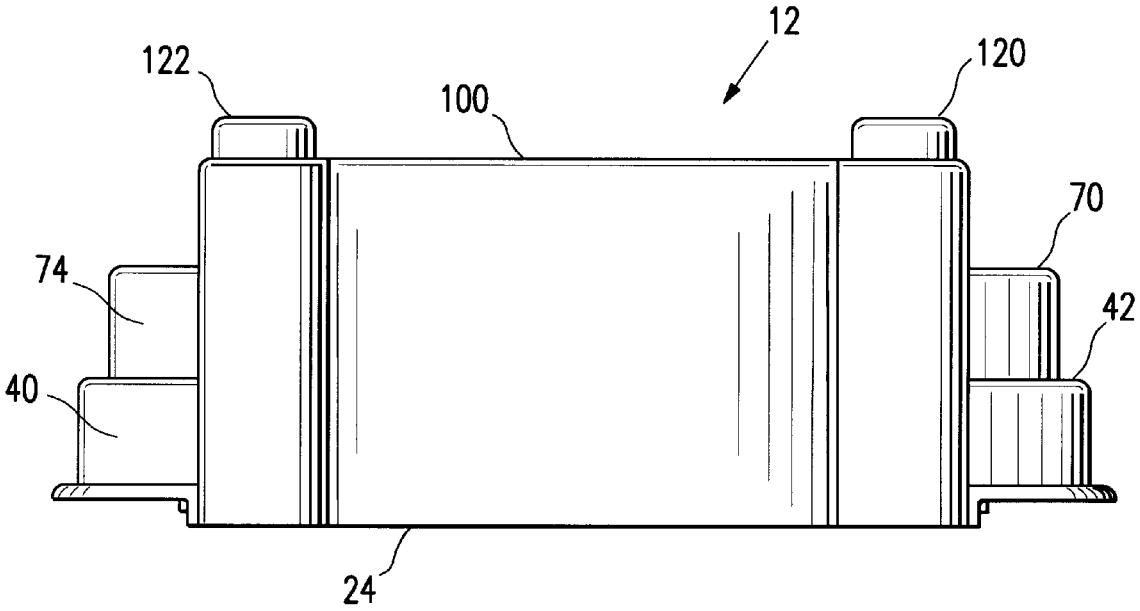
FIG. 5 is a back elevation view of the base shown in FIGS. 2–4.

While the present invention is open to various modifications and alternative constructions, the preferred embodiment shown in the drawings will be described herein in detail. It is understood, however, that there is no intention to limit the invention to the particular form disclosed. On the contrary, the intention is to cover all modifications, equivalent structures and methods, and alternative constructions falling within the spirit and scope of the invention as expressed in the appended claims.

To illustrate the simplicity of the present invention, reference is made to FIG. 1, where there is illustrated a craft set 10 comprising a base 12 and various accessories. These accessories include nail enhancing items and nail enhancing tools and these will be described hereinbelow. As can be seen from FIG. 1, the craft set is compact and aesthetically pleasing. Referring now to FIGS. 1–5, the base 12 is divided into five regions 14, 16, 18, 20 and 22. These regions are at different vertical heights or levels relative to a bottom 24 of the base and arc arranged generally so that the regions get progressively higher starting at the lowest vertical level of the first region 14.

The first region is generally elliptical in plan view and includes a top surface 26, four finger recesses 28, 30, 32 and 34 and a front wall portion 36. It can be appreciated that the fingers from a user's hand may be placed in the four recesses while the user may use his/her other hand to decorate or enhance the fingernails of the fingers resting in the recesses.

Separating the first region 14 from the second region 16 is a peripheral wall 40. The second region also has a generally flat top surface 42 and a series of recesses or bins 44, 46, 48, 50, 52, 54, 56 and 58. These bins are roughly rectangular in shape although the end bins 44 and 58 have long curved outer walls 60 and 62. The bins may be used for storage of such accessories as cotton balls 61, emery boards 63 and faux nails (not shown). The top surface 42 of the second regions is at a higher elevation than the top surface 26 of the first region.

The third region 18 also has a generally flat top surface 70 which is at an elevation level higher than the top surface 42 of the second region and is separated from the second region by a vertical wall 74. The third region is shown with five recesses 80, 82, 84, 86 and 88. The three center recesses 82, 84, 86 have a circular configuration and may be used to locate and store accessories such as glitter gel tubes 90 and 92 and a buffer 94. The outer two recesses may be used for storing adhesive stickers, tweezers and cotton swabs (none of which are shown).

The fourth region 20 also has a generally flat top surface 100 which is separated from the top surface 70 of the third region by a vertical wall 102. As with the previous regions, the fourth region has recesses such as the recesses 104, 106 and 108. These may be used to receive nail polish containers 110, 112 and 114.

The fifth region 22 is divided into left and right parts. Each part has a top surface 120, 122 at a higher elevation than the top surface 100 of the fourth region and is separated from the fourth region by cylindrical walls 124 and 126, respectively. Two openings 121, 123 are provided in the top surfaces. As will be explained below, the fifth region supports flexible tubes 130, 132 which in turn support tools such as a magnifying glass 134 and a fan 136, respectively. The tubes are mounted in the openings.

The base 12 may be made of molded ABS synthetic resin having a generally oval plan view with a long dimension of about 10 inches and a short dimension of about 6 inches. The first region may have a long dimension of about 7.4 inches and a short dimension of about 2.7 inches. The recesses or indentations may be approximately 0.125 inches deep. The top surface 26 may be 0.375 inches above the bottom 24 of the base. The top surface 42 of the second region is about 1 inch above the top surface 26 of the first region and each bin may be approximately one inch deep. The third region 18 has a top surface 70 about 1 inch higher than the top surface 42 of the second region and have recesses of varying depths. For example, storage bins 80, 88 may be two inches deep whereas the bins 82, 84, 86 are only an inch deep. The fourth region 20 has a top surface 100 an inch above the top surface 70 and three recesses 104, 106, 108 having a depth of approximately 0.626 inches. The peripheral shape of the recesses accommodate standard nail polish bottles.

The fifth region 22 has two top surfaces 120, 122 about 0.375 inches above the top surface 100. There arc recesses which may have outer diameters of one inch and inner diameters of 0.675 inches. The base may also include two pegs 127, 128 for engagement with another base described in co-pending application, Ser. No. 09/244,287, filed on Feb. 3, 1999, and entitled Fingernail Stamper Craft Set. This application is incorporated here by reference.

Figure 6:
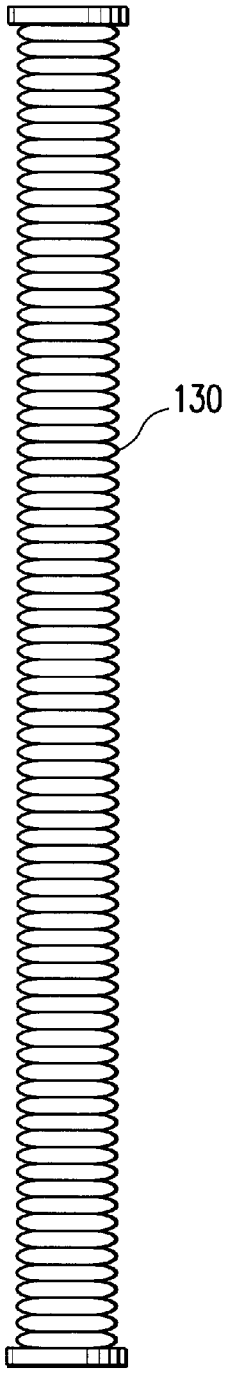
FIG. 6 is a front elevation view of a tube to be connected to the base of the for supporting a fingernail enhancing tool.

Referring now to FIGS. 1 and 6, is illustrated two flexible support tubes 130, 132 which are constructed of a series of bellows. This construction provides for a self support and allows the tubes to be flexed or bent in a number of different positions so that tools mounted to the ends of the tubes may be used with ease by an operator of the craft set. As will be explained hereinbelow, the tubes 130,132 support the magnifying glass and the fan. Each tube may be molded of a suitable material and is constricted so as to not pinch the fingers of the user when the tubes are manipulated.

Figure 7:
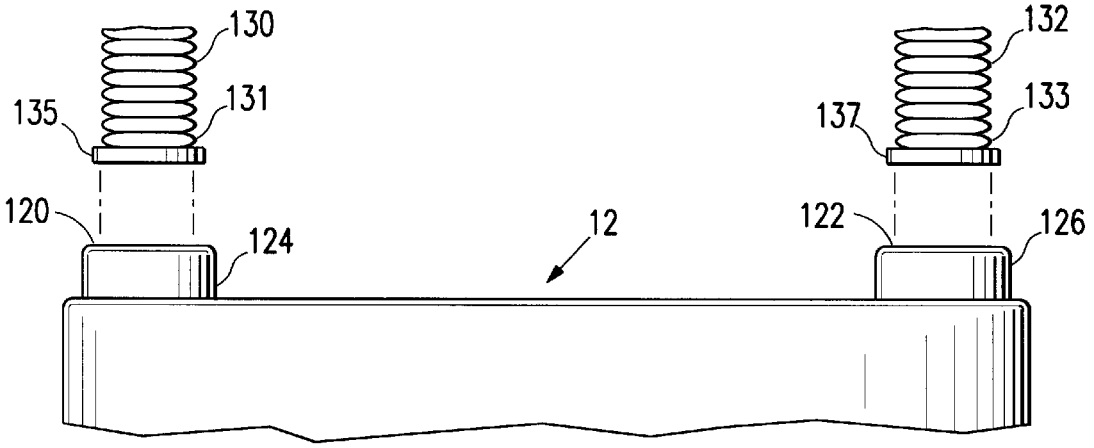
FIG. 7 is an exploded view of a portion of the base illustrating two tubes that are connected to the base of the present invention.

Reference is now made to FIG. 7 in which the bottom ends 131 and 133 of the tubes are connected to the base 12 by having enlarged end pieces 135,137 of each tube restrained in an interference fit with the base 12.

Figure 8:
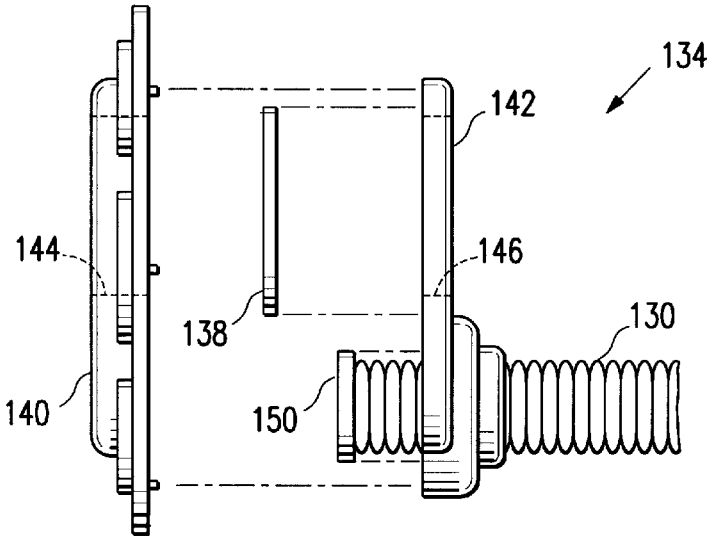
FIG. 8 is an exploded elevation view of a magnifying lens and supporting housing of the present invention.

Referring now to FIG. 8, there is illustrated the magnifying lense assembly 134. This assembly includes a magnifying glass 138, a front lense holder 140 and a rear lense holder 142. The magnifying lense is trapped between the two holders and is usable because there is an opening 144 in the front holder and an opening 146 in the rear holder thereby allowing a user to look through the magnifying lense. As explained above regarding the connection between the flexible tube and the base, a similar interference fit may be used to attach the upper end 150 of the tube 130 to the lense assembly.

Figure 9:
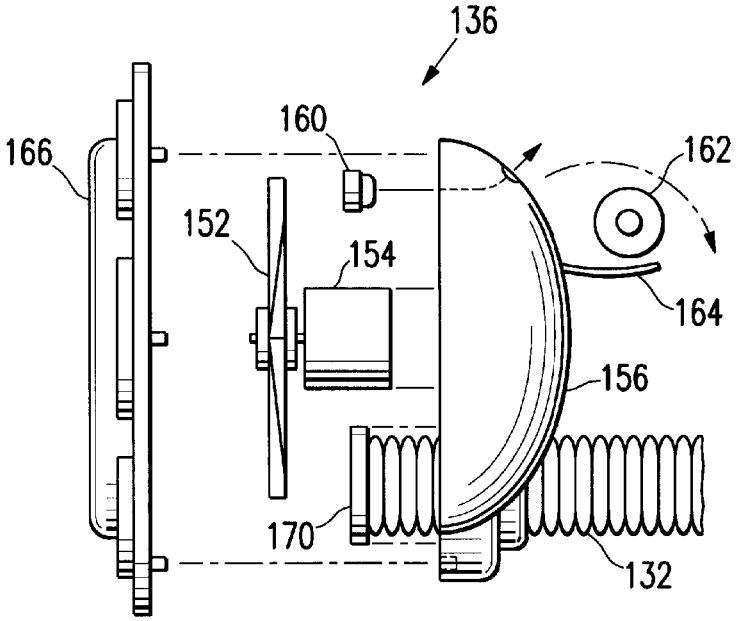
FIG. 9 is an exploded elevation view of a fan and supporting housing of the present invention.

Referring now to FIG. 9, there is illustrated the fan assembly 136 comprising a fan blade 152, and a motor 154 which are mounted to a back piece 156. Also mounted to the back piece is an on-off button 160, a battery 162, a battery door 164 and electrically conductive material (not shown) which connect the battery, the button and the motor of the fan. The fan assembly also includes a front piece 166 having an open grill face 168, FIG. 1. The top end 170 of the tube is connected by an interference fit to the fan assembly in the same manner as described for the connection of the tubes 130 and 132 to the base.

Figure 10:
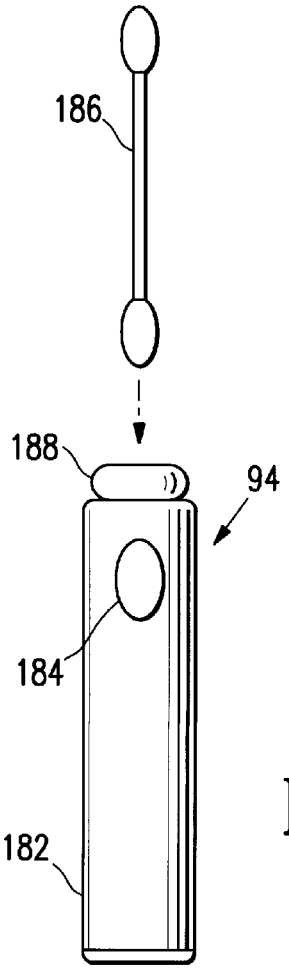
FIG. 10 is a partially exploded elevation view of a buffer of the present invention.

Referring now to FIG. 10, there is illustrated a buffer assembly 94 which comprises a battery and wiring (not shown) within the body 182, an on-off switch 184 and a cotton swab 186. The cotton swab is attached to the body by a twist ring 188 which may be manipulated to twist in one direction to open pinchers (not shown) and in an opposite direction to close the pinchers around the cotton swab. In use, a child, for example, can rotate the twist ring to open the pinchers, then insert the cotton swab, followed by a reverse rotation to close the pinchers.

In operation, a user may set up the base with various accessories in the bins and recesses. These accessories include nail polish, glitter and stick-ons, for example. The user may also include working items such as cotton balls, emery boards and nail polish remover, for example. Finally, tools "built-in" to the base in the form of the magnifying glass and the fan are available to help in the application of polish, glitter, stickers and the like.

The user would usually begin by placing the fingers of one of his/her hands on the indentations or recesses in the first region, and then with the other hand, decorate the nails of the first mentioned hand.

The specification describes in detail an embodiment of the present invention. Other modifications and variations will, under the doctrine of equivalents, come within the scope of the appended claims. For example, having different size bins, recesses or openings or a greater number or lesser number of such features are considered to be equivalent structures. In a like manner, having different nail accessories or tools than those mentioned, are also considered to be equivalent. Still other alternatives will also be equivalent as will many new technologies and materials. There is no desire or intention here to limit in any way the application of the doctrine of equivalents.

We claim:

1. A craft set for enhancing fingernails of a user, said set comprising:

an integral base having a generally elliptical plan view symmetrical about a short axis of said base;

said base having a plurality of vertically displaced levels with each level having a region of recesses or openings;

two elongated flexible tubes connected to said base at the region at the highest vertical level, each of said tubes having an extended end;

a magnifying lens connected to the end of one of said tubes; and a fan connected to the end of the other of said tubes.

2. An apparatus as claimed in claim 1 including:

a first region located at the lowest vertical level and having finger accommodating recesses;

a second region located at the next lowest vertical level and having a plurality of generally rectangular bins;

a third region located at a vertical level higher than said second region and having a combination of circular and generally rectangular bins;

a fourth region located at a vertical level higher than said third region and having a plurality of bins; and a fifth region located at a higher level than said fourth region and having two portions for receiving said two tubes.

3. An apparatus as claimed in claim 2 including:

fingernail accessory items including, cotton, emery boards, adhesive stickers, tweezers, glitter gel, nail polish and nails being located in selected bins; and a nail buffer located in one of said bins.

4. An apparatus as claimed in claim 2 including:

a curved vertical wall disposed between said first and said second regions for defining with said elliptical plan view the shape of said first region;

a second curved vertical wall extending between said second and third regions;

a third generally curved vertical wall extending between said third and said fourth regions; and a generally curved back wall extending from the bottom of said base to the fourth region.

5. An apparatus as claimed in claim 2 including:

a slot formed in said base for receiving a second base; and first and second peg elements connected to said base, being disposed near said slot for engaging the received second base.

6. An apparatus as claimed in claim 5 including:

a slot formed in said base for receiving a second base; and first and second peg elements connected to said base, said pegs being disposed near said slot for engaging a received second base.

* * * * *